US006962142B2

(12) United States Patent
Sekine

(10) Patent No.: US 6,962,142 B2
(45) Date of Patent: Nov. 8, 2005

(54) FUEL INJECTION SYSTEM AND MANUFACTURING METHOD THEREOF

(75) Inventor: Atsushi Sekine, Ibaraki (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/895,897

(22) Filed: Jul. 22, 2004

(65) Prior Publication Data

US 2005/0045151 A1 Mar. 3, 2005

(30) Foreign Application Priority Data

Sep. 2, 2003 (JP) ..... 2003-310051
Dec. 8, 2003 (JP) ..... 2003-409101

(51) Int. Cl.[7] ..... F02M 55/02; F02M 63/02
(52) U.S. Cl. ..... 123/470; 123/456
(58) Field of Search ..... 123/456, 467, 123/468, 470

(56) References Cited

U.S. PATENT DOCUMENTS 4,457,280 A * 7/1984 Hudson, Jr. ..... 123/470
4,660,524 A * 4/1987 Bertsch et al. ..... 123/468
5,168,857 A * 12/1992 Hickey ..... 123/468
5,577,663 A 11/1996 Nally et al.
6,186,122 B1 * 2/2001 Leung ..... 123/470
6,374,809 B2 * 4/2002 Satou ..... 123/470
6,390,067 B1 * 5/2002 Haltiner et al. ..... 123/470
6,431,151 B1 * 8/2002 Gmelin ..... 123/470
6,725,839 B2 * 4/2004 Zdroik et al. ..... 123/456
6,748,925 B1 * 6/2004 De Vulpillieres et al. .. 123/470
2002/0038649 A1 * 4/2002 Scollard et al. ..... 123/456
2003/0024507 A1 2/2003 Boecking
2003/0070658 A1 * 4/2003 Warner et al. ..... 123/456

FOREIGN PATENT DOCUMENTS

DE 102 42 894 A1 3/2004
EP 1 304 477 A2 4/2003

* cited by examiner

*Primary Examiner*—Weilun Lo
(74) *Attorney, Agent, or Firm*—Sughrue Mion, PLLC

(57) ABSTRACT

A fuel injection system includes a fuel feed pipe for feeding fuel from a fuel tank and including upper and lower feed-pipe members joined to each other, and a plurality of fuel injection valves connected to the fuel feed pipe, each fuel injection valve including a cylinder having a fuel passage formed therethrough, a valve device arranged in the cylinder to open and close the fuel passage, and an electromagnetic actuator for driving the valve device. The cylinder of each fuel injection valve is integrated with the lower feed-pipe member.

13 Claims, 4 Drawing Sheets

FUEL INJECTION SYSTEM AND MANUFACTURING METHOD THEREOF

BACKGROUND OF THE INVENTION

The present invention relates to a fuel injection system for an internal combustion engine, wherein fuel in a fuel tank is supplied to a fuel injection valve, and injected therethrough to the suction side of the engine.

Typically, as disclosed in EP 1 304 477 A2, the fuel injection system comprises a fuel feed pipe for feeding fuel from the fuel tank and a plurality of fuel injection valves connected thereto, wherein the fuel injection valves inject fuel at a predetermined timing and by a predetermined amount to the suction side of the engine. The fuel feed pipe and the fuel injection valve are formed as separate and distinct parts, and are connected to each other by joining the feed-port side of the fuel feed pipe to one end of a cylinder of the fuel injection valve by welding or the like.

SUMMARY OF THE INVENTION

The fuel injection valves connected to the fuel feed pipe cannot be assembled to the engine under no stress, and each undergoes stress at a connecting point with the fuel feed pipe. With the typical fuel injection system, a joining point of the two members obtained by welding or the like is often broken by application of stress during assembling, which will become, if broken, a cause of future leakage of fuel to the outside.

It is, therefore, an object of the present invention to provide a fuel injection system and manufacturing method thereof, which allow prevention of a connecting point of the fuel feed pipe and each fuel injection valve from easily being broken by application of stress, The present invention provides generally a fuel injection system, which comprises: a tank having a fuel accumulated therein; a pipe which feeds the fuel, the pipe comprising a plurality of division members joined to each other; and a plurality of injection valves connected to the pipe, each injection valve comprising a cylinder having a passage formed therethrough, a valve device arranged in the cylinder to open and close the passage, and an actuator which drives the valve device, the cylinder being integrated with one of the division members of the pipe.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
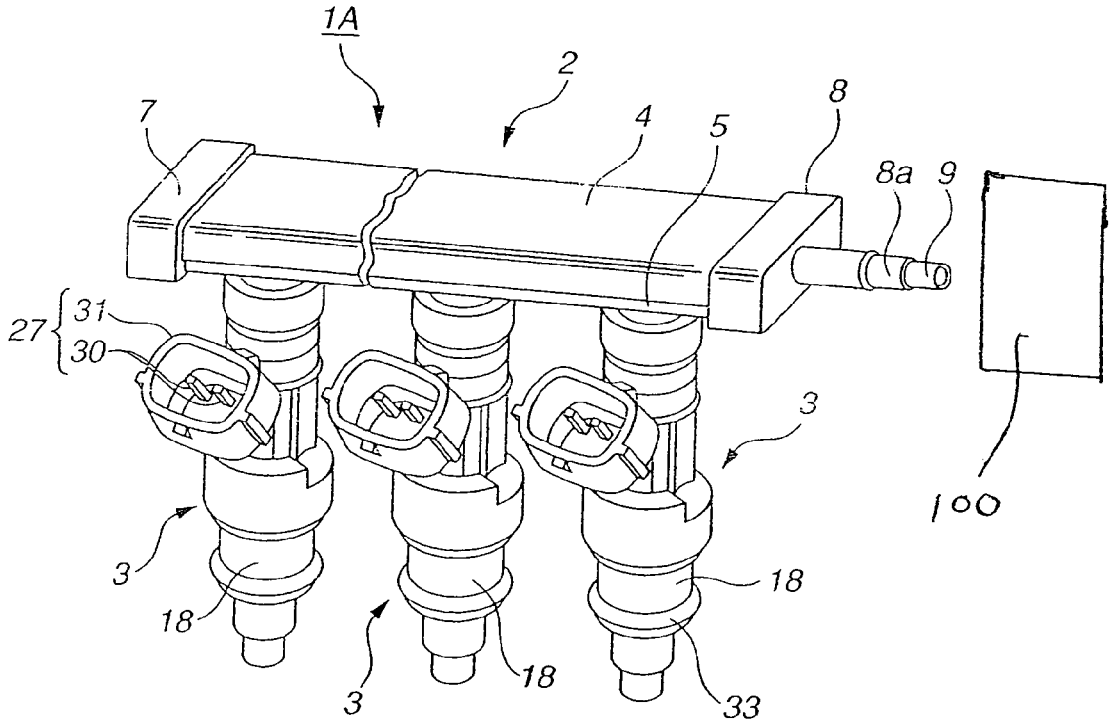
FIG. 1 is a perspective view of a first embodiment of a fuel injection system according to the present invention.

Referring to the drawings, a fuel injection system embodying the present invention is described.

Figure 2:
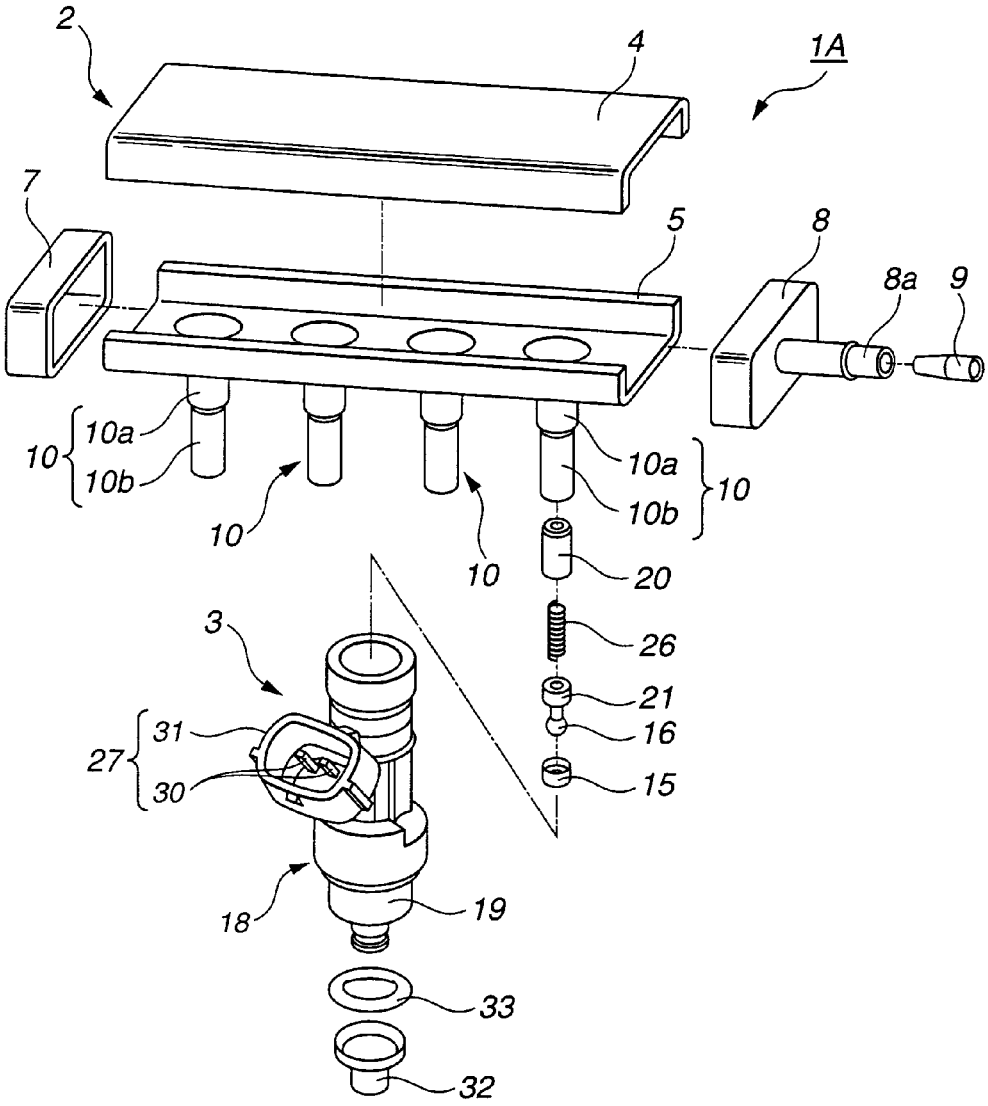
FIG. 2 is an exploded perspective view of the fuel injection system.
Figure 3:
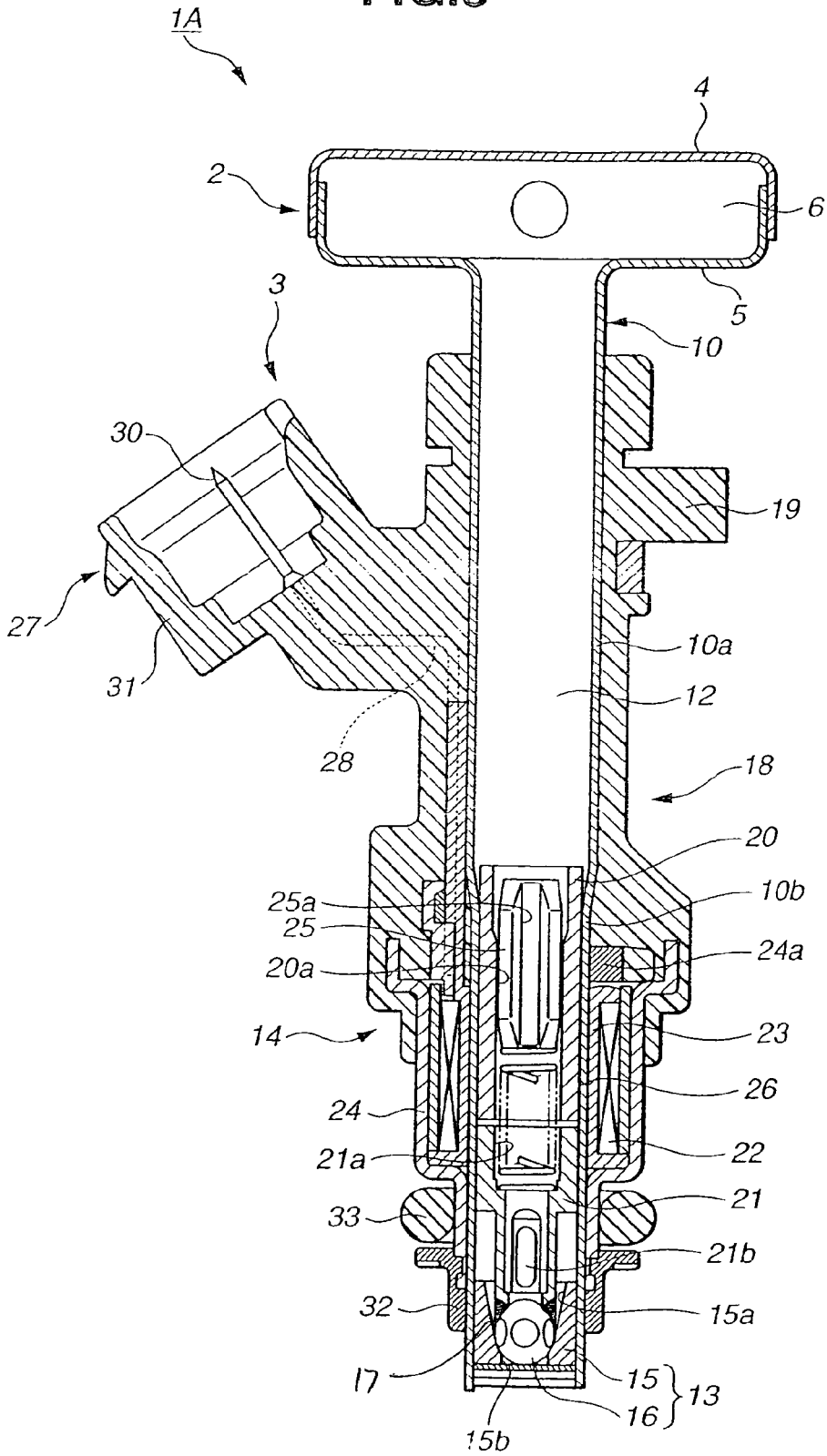
FIG. 3 is a sectional view of the fuel injection system.

Referring to FIGS. 1–3, there is shown first embodiment of the present invention. Referring to FIGS. 1 and 2, a fuel injection system 1A comprises a fuel feed pipe 2 for feeding fuel from a fuel tank 100, and a four fuel injection valves 3 connected to fuel feed pipe 2.

As best seen in FIG. 2, fuel feed pipe 2 comprises upper and lower feed-pipe members 4, 5, which have a straight shape and are configured to cooperate to each other to define thereinside an enclosed passage 6. Upper and lower feed-pipe members 4, 5 have connecting points joined by welding, soldering, or the like, and seal members 7, 8 joined thereto at both ends by welding or the like. Seal members 7, 8 serve to close enclosed passage 6, wherein seal member 8 includes an introduction pipe 8*a* for connection to the fuel tank. Introduction pipe 8*a* allows introduction of fuel from the fuel tank to fuel feed pipe 2. A fuel filter 9 is press fitted into introduction pipe 8*a* to trap impurities contained in fuel.

Upper and lower feed-pipe members 4, 5 are formed of a metal thin plate by press working. Four cylinders 10 are formed with lower feed-pipe member 5 at given intervals by a deep drawing process, for example. That is, four fuel injection valves 3 include respective cylinders 10 integrated with lower feed-pipe member 5 of fuel feed pipe 2. Each cylinder 10 has a cylindrical shape, and comprises a large-diameter portion 10*a* located on the base side and a small-diameter portion 10*b* located on the front-end side and continuously connected thereto.

Referring to FIG. 3, each fuel injection valve 3 comprises cylinder 10 integrated with lower feed-pipe member 5 and having a fuel passage 12 formed therethrough, a valve means or device 13 arranged in cylinder 10 and for opening and closing fuel passage 12, and an electromagnetic actuator 14 for driving valve means 13.

Valve means 13 comprises a valve-seat member 15 fixed to a lower end of cylinder 10 and having a valve-element hole 15*a* vertically formed therethrough, and a roughly spherical valve element 16 movably arranged in valve-element hole 15*a* of valve-seat member 15. Valve-element hole 15*a* has a diameter reduced stepwise from top to bottom, wherein one of the stepped faces serves as a bearing surface 17. An injection opening or nozzle 15*b* is arranged in the bottom of valve-element hole 15*a*. Injection opening 15*b* opens to a suction pipe, not shown.

Valve element 16 is movable between a valve closed position (position shown in FIG. 3) where it makes close contact with bearing surface 17 by a driving force of electromagnetic actuator 14 and a valve open position where it separates upward from bearing surface 17. In the valve closed position of valve means 13, valve-element hole 15*a* of valve-seat member 15 is closed to block injection of fuel through injection opening 15*b*. On the other hand, in the valve open position of valve means 13, valve-element hole 15*a* of valve-seat member 15 is opened to allow injection of fuel through injection opening 15*b*.

Electromagnetic actuator 14 comprises a stationary iron core 20 fixed in cylinder 10 by press fitting, a movable iron core 21 vertically movably arranged in cylinder 10, and an actuator assembly 18 as a valve casing fixed on the outer periphery of cylinder 10 and thus over iron cores 20, 21 by press fitting.

Actuator assembly 18 is obtained by integrating actuator parts 22, 23, 24 disposed outside cylinder 10 together with a resin molding material by insert molding, and comprises an electromagnetic coil or actuator part 22 arranged in a resin molding 19, a bobbin or actuator part 23 disposed on the inner periphery of electromagnetic coil 22 and having coil 22 wound thereon, a metallic yoke or actuator part 24 disposed on the outer periphery of electromagnetic coil 22 and for forming a magnetic path, and a metallic plate 24*a* disposed on the inner periphery and at the upper end of yoke 24 and for forming a magnetic path. The minimum inner diameter of yoke 24 and the inner diameter of plate 24*a* are set at a dimension which allows their press fitting onto the outer periphery of cylinder 10.

Actuator assembly 18 has a front end press fitted onto cylinder 10. A stopper 32 is fixed to a lower portion of cylinder 10 into which actuator assembly 18 is press fitted. Stopper 32 allows sure fixing of actuator assembly 18 to cylinder 10. A packing 33 is engaged on a lower end of actuator assembly 18 to ensure shield connection between fuel injection valve 3 and the suction pipe.

Stationary iron core 20 is formed with an axial hole 20*a* which opens in the upper and lower surfaces. Movable iron core 21 is formed with an axial hole 21*a* which opens in the upper surface and a side hole 21*b* which communicates with axial hole 21*a* and opens in the peripheral surface. Movable iron core 21 is arranged adjacent to a lower portion of stationary iron core 20, and has a lower end fixed to valve element 16 by welding or the like. Thus, valve element 16 is displaced together with movable iron core 21, wherein the position where movable iron core 21 abuts on stationary iron core 20 corresponds to valve open position, and the position where valve element 16 abuts on or makes close contact with bearing surface 17 corresponds to valve closed position.

A spring bearing member 25 is fixed in stationary iron core 20. A compression coil spring 26 has an upper end abutting on spring bearing member 25 and a lower end abutting on movable iron core 21. Valve element 15 is biased to the valve closed position by a biasing force of compression coil spring 26. When energizing electromagnetic actuator 22, movable iron core 21 is displaced upward by an electromagnetic force of actuator 22, causing displacement of valve element 16 to the valve open position. When terminating energization of electromagnetic actuator 22, movable iron core 21 is returned to the valve closed position by a biasing force of compression coil spring 26.

Portions of fuel passage 12 having electromagnetic actuator 14 interposed therebetween are in fluid communication through a through hole 25*a* of spring bearing member 25, axial hole 20*a* of stationary iron core 20, axial hole 21*a* of movable iron core 21, and side hole 21*b* of movable iron core 21. Therefore, passing through hole 25*a* of spring bearing member 25, axial hole 20*a* of stationary iron core 20, axial hole 21*a* of movable iron core 21, and side hole 21*b* of movable iron core 21 in this order, fuel in the portion of fuel passage 12 above electromagnetic actuator 14 flows into the portion of fuel passage 12 below electromagnetic actuator 14.

A connector 27 is provided to actuator assembly 18, and comprises a terminal 30 including one end of a conductive rod 28 and a connector housing 31 integrated with resin molding 19. Another end of conductive rod 28 is connected to electromagnetic coil 28 of electromagnetic actuator 14. Electromagnetic coil 28 is energized through connector 27.

Next, an example of assembling procedure of fuel injection system 1A is described. Upper feed-pipe member 4, lower feed-pipe member 5, and seal members 7, 8 are assembled together. Then, their connecting points are joined by welding, soldering, or the like, obtaining fuel feed pipe 2.

From the front end, stationary iron core 20 is press fitted into cylinder integrated with fuel feed pipe 2. Spring bearing member 25 is fixed in stationary iron core 20 in advance.

Inserted into cylinder 10 are compression coil spring 26 and movable iron core 21 with valve element 16, then valve-seat member 15. In place of press fitting into cylinder 10, stationary iron core 20 and valve-seat member may be fixed therein by caulking, welding, soldering, or the like.

From the front end, actuator assembly 18 is press fitted onto the outer periphery of cylinder 10 integrated with fuel feed pipe 2. Since cylinder 10 comprises large-diameter portion 10*a* and small-diameter portion 10*b*, actuator assembly 18 is inserted up to a position where its inside stepped portion abuts on large-diameter portion 10*a*. Packing 33 is mounted to the lower end of actuator assembly 18 in advance.

Finally, from the front end, stopper 32 is press fitted onto the outer periphery of cylinder 10 integrated with fuel feed pipe 2. In place of press fitting into cylinder 10, actuator assembly 18 and stopper 32 may be fixed to cylinder 10 by caulking, welding, soldering, or the like.

Next, operation of fuel injection valve 3 is described. Valve element 16 is located in the valve closed position, and fuel passage 12 has pressurized fuel flowing therein. In this state, when energizing electromagnetic actuator 14, valve element 16 is displaced from the valve closed position to the valve open position so that fuel in fuel passage 12 is injected through injection opening 15*b*. When stopping energization of electromagnetic actuator 14, valve element 16 is returned to the valve closed position, stopping injection of fuel. In such a way, energization/non-energization of electromagnetic actuator 14 allows injection of fuel into the suction pipe at a predetermined timing and by a desired amount.

As described above, with fuel injection system 1A, fuel feed pipe 2 and fuel injection valve 3 are connected not by joining at the connecting point by welding, soldering, or the like as in the related art, but by integration of lower feed-pipe member 5 and cylinder 10, providing very firm structure. This prevents easy breakage of the boundary between fuel feed pipe 2 and fuel injection valve 3 due to application of stress and the like during assembling to an internal combustion engine, not shown. Thus, future leakage of fuel to the outside due to breakage can be prevented from occurring.

In the related art, joining such as welding is needed all around cylinders 10 of fuel injection valves 3. However, it is difficult to provide a sufficient working space for joining, which renders joining work complicated. On the other hand, in this embodiment, a sufficient working space can be provided, facilitating joining work. Moreover, for the same reasons, inspection work for fuel leakage can be made easily.

In a related-art technique, a packing member such as an O-ring is used for sealing the connecting point of fuel feed pipe 2 and fuel injection pipe 3. However, the use of the packing member may cause fuel leakage due to its hardening by longtime contact with fuel. On the other hand, in this embodiment, since no packing member is used, fuel leakage due to deterioration of the packing member does not occur.

In the first embodiment, upper and lower feed-pipe members 4, 5 are formed of a metallic thin plate, and thus fuel feed pipe 2 itself undergoes elastic deformation easily by pulsation of fuel, leading to a reduction in pulsation.

Further, in the first embodiment, the actuator parts to be disposed outside cylinder 10 of electromagnetic actuator 14 are formed integrally as actuator assembly 18. Thus, by manufacturing actuator assembly 18 separately from cylinder 10, then assembling manufactured actuator assembly 18 to cylinder 10, assembling of actuator parts 22, 23, 24 to be disposed outside cylinder 10 can be achieved, resulting in easy manufacturing of the system.

Still further, in the first embodiment, since connector 27 is provided to actuator assembly 18, connector 27 can be assembled together with actuator assembly 18 to cylinder 10 at the same time, resulting in simplified assembling work.

Furthermore, in the first embodiment, since actuator assembly 18 is fixed to cylinder 10 by press fitting, fixing can be achieved by easy assembling work of press fitting actuator assembly 18 onto cylinder 10.

Further, in the first embodiment, since fuel feed pipe 2 is obtained by joining two feed-pipe members, i.e. upper and lower feed-pipe members 4, 5, fuel feed pipe 2 can be formed with the minimum number of division parts, resulting in a reduction in manufacturing cost of the system with the number of assembling processes and that of joining processes kept to a minimum.

In the first embodiment, fuel feed pipe 2 has a straight shape. Optionally, fuel feed pipe 2 may have a bent shape in accordance with the mounting position of fuel feed pipes 3. In the first embodiment, upper and lower feed-pipe members 4, 5 are formed of a metallic thin plate by press working, allowing easy achievement of a desired bent shape.

Figure 4:
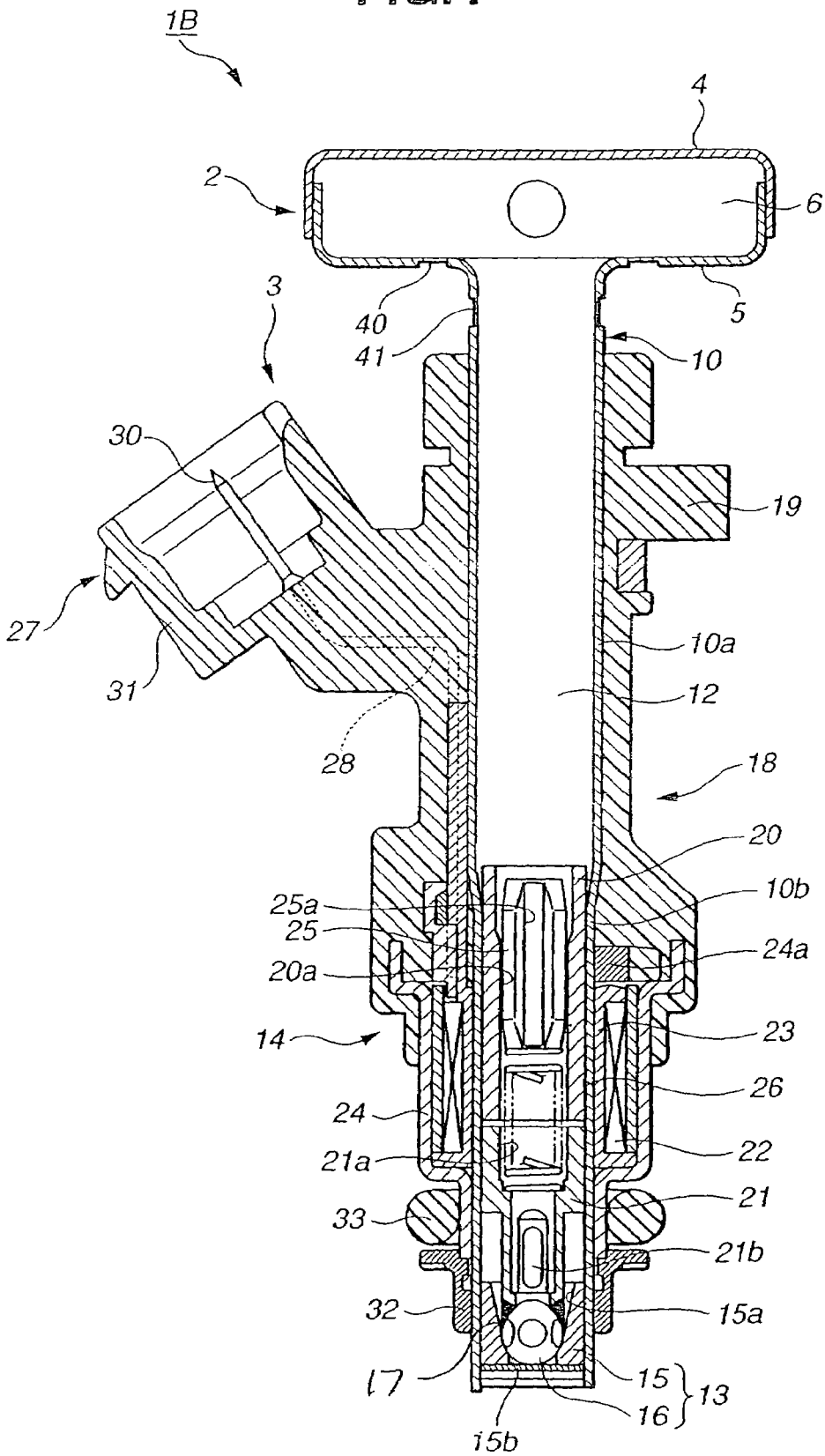
FIG. 4 is a view similar to FIG. 3, showing a second embodiment of the present invention.

Referring to FIG. 4, there is shown second embodiment of the present invention which is substantially the same as the first embodiment. A fuel injection system 1B in the second embodiment differs from fuel injection system 1A in the first embodiment in that annular small-thickness portions 40 are provided to lower feed-pipe member 5, each being located in the position exterior of the boundary between lower feed-pipe member 5 and cylinder 10, and in that small-thickness portions 41 are provided to respective cylinders 10, each being located in the outer peripheral position in the vicinity of the boundary between lower feed-pipe member 5 and cylinder 10.

In the second embodiment as well, fuel feed pipe 2 and fuel injection valve 3 are connected not by joining at the connecting point by welding, soldering, or the like as in the related art, but by integration of lower feed-pipe member 5 and cylinder 10, providing very firm structure. This prevents easy breakage of the boundary between fuel feed pipe 2 and fuel injection valve 3 due to application of stress and the like during assembling to the internal combustion engine. Thus, future leakage of fuel to the outside due to breakage can be prevented from occurring.

Further, in the second embodiment, since annular small-thickness portions 40 are provided to lower feed-pipe member 5, each being located in the position exterior of the boundary between lower feed-pipe member 5 and cylinder 10, deformation of annular small-thickness portion 40 allows absorption of vertical and circumferential mounting errors of fuel injection valve 3. Moreover, since small-thickness portions 41 are provided to respective cylinders 10, each being located in the outer peripheral position in the vicinity of the boundary between lower feed-pipe member 5 and cylinder 10, deformation of small-thickness portion 41 allows absorption of a circumferential mounting error of fuel injection valve 3.

As described above, according to the present invention, fuel feed pipe and fuel injection valve are connected not by joining at the connecting point by welding, soldering, or the like as in the related art, but by integration of lower feed-pipe member and cylinder, providing very firm structure. This prevents easy breakage of the boundary between fuel feed pipe and fuel injection valve due to application of stress and the like during assembling to an internal combustion engine. Thus, future leakage of fuel to the outside due to breakage can be prevented from occurring.

In the related art, joining such as welding is needed all around cylinders of fuel injection valves. However, it is difficult to provide a sufficient working space for joining, which renders joining work complicated. On the other hand, according to the present invention, a sufficient working space can be provided, facilitating joining work. Moreover, for the same reasons, inspection work for fuel leakage can be made easily.

In a related-art technique, a packing member such as an O-ring is used for sealing the connecting point of fuel feed pipe 2 and fuel injection pipe. However, the use of the packing member may cause fuel leakage due to its hardening by longtime contact with fuel. On the other hand, according to the present invention, since no packing member is used, fuel leakage due to deterioration of the packing member does not occur.

Further, according to the present invention, deformation of annular small-thickness portion allows absorption of vertical and circumferential mounting errors of fuel injection valve.

Still further, according to the present invention, deformation of small-thickness portion allows absorption of a circumferential mounting error of fuel injection valve.

Furthermore, according to the present invention, by manufacturing actuator assembly separately from cylinder, then assembling manufactured actuator assembly to cylinder, assembling of actuator parts to be disposed outside cylinder can be achieved, resulting in easy manufacturing of the system.

Further, according to the present invention, fuel feed pipe itself undergoes elastic deformation easily by pulsation of fuel, leading to a reduction in pulsation.

Further, according to the present invention, connector can be assembled together with actuator assembly to cylinder at the same time, resulting in simplified assembling work.

Still further, according to the present invention, fixing can be achieved by easy assembling work of press fitting actuator assembly onto cylinder.

Furthermore, according to the present invention, fuel feed pipe can be formed with the minimum number of division parts, resulting in a reduction in manufacturing cost of the system with the number of assembling processes and that of joining processes kept to a minimum.

Having described the present invention in connection with the illustrative embodiments, it is noted that the present invention is not limited thereto, and various changes and variations can be made without departing from the scope of the present invention.

By way of example, in the illustrative embodiments, fuel feed pipe 2 comprises two members, i.e. upper and lower feed-pipe members 4, 5. Optionally, fuel feed pipe 2 may comprise three or more members.

Further, in the illustrative embodiments, connector 27 is provided to actuator assembly 18. Optionally, connector 27 may not be provided to actuator assembly 18.

Still further, in the illustrative embodiments, four fuel injection valves 3 are connected to fuel feed pipe 2. The required number of fuel injection valves 3 is not limited thereto, and can be two or more. Note that, in the related art, the number of joining points increases in proportion to the number of fuel injection valves 3, whereas, in the present invention, the number of joining points is constant irrespective of the number of fuel injection valves 3.

Furthermore, in the second embodiment, small-thickness portions 40, 41 are provided to lower feed-pipe member 5 and cylinder 10, respectively. Optionally, small-thickness portions may be provided to one of lower feed-pipe member 5 and cylinder 10.

The entire teachings of Japanese Patent Application 2003-409101 filed Dec. 8, 2003 are hereby incorporated by reference.

What is claimed is:

1. A fuel injection system, comprising:

a tank having a fuel accumulated therein;

a pipe which feeds the fuel, the pipe comprising a plurality of division members joined to each other; and a plurality of injection valves connected to the pipe, each injection valve comprising a cylinder having a passage formed therethrough, a valve device arranged in the cylinder to open and close the passage, and an actuator which drives the valve device, the cylinder being integrated seamlessly with one of the division members of the pipe.

2. The fuel injection system as claimed in claim 1, wherein the one of the division members of the pipe comprises small-thickness portions each formed in a position exterior of a boundary between the one of the division members and the cylinder.

3. The fuel injection system as claimed in claim 1, wherein the cylinder comprises a small-thickness portion formed in an outer peripheral position in the vicinity of a boundary between the one of the division members and the cylinder.

4. The fuel injection system as claimed in claim 1, wherein the actuator of the injection valve comprises component parts disposed outside the cylinder, the components parts being formed integrally as an assembly.

5. The fuel injection system as claimed in claim 1, wherein the division members of the pipe are made of a metallic thin plate.

6. The fuel injection system as claimed in claim 4, further comprising a connector provided to the assembly.

7. The fuel injection system as claimed in claim 4, wherein the assembly is fixed onto the cylinder by press fitting.

8. The fuel injection system as claimed in claim 1, wherein the division members of the pipe include two division members.

9. A fuel injection system, comprising:

a tank having a fuel accumulated therein;

pipe means for feeding the fuel, the pipe means comprising a plurality of division members joined to each other; and a plurality of injection valves connected to the pipe means, each injection valve comprising a cylinder having a passage formed therethrough, valve means arranged in the cylinder for opening and closing the passage, and an actuator which drives the valve means, the cylinder being integrated seamlessly with one of the division members of the pipe means.

10. A method of manufacturing a fuel injection system with a plurality of injection valves, comprising:

preparing a pipe by joining a plurality of division members, one of the division members being formed seamlessly with a cylinder, the cylinder comprising large-diameter and small-diameter portions;

press fitting a stationary iron core into the cylinder;

inserting a compression coil spring and a movable iron core with a valve element into the cylinder;

press fitting a valve-seat member into the cylinder;

fixing an actuator assembly onto an outer periphery of the cylinder up to a position where its inside stepped portion abuts on the large-diameter portion of the cylinder; and fixing a stopper onto the outer periphery of the cylinder, wherein the cylinder constitutes the injection valve.

11. The method as claimed in claim 10, wherein the one of the division members of the pipe comprises small-thickness portions each formed in a position exterior of a boundary between the one of the division members and the cylinder.

12. The method as claimed in claim 10, wherein the cylinder comprises a small-thickness portion formed in an outer peripheral position in the vicinity of a boundary between the one of the division members and the cylinder.

13. The method of claim 10, wherein the one of the division members is formed seamlessly with a cylinder by a deep drawing process.

* * * * *